US007565896B1

(12) United States Patent
Yang

(10) Patent No.: US 7,565,896 B1
(45) Date of Patent: Jul. 28, 2009

(54) METHOD FOR VARIABLE VALVE ACTUATION TO PROVIDE POSITIVE POWER AND ENGINE BRAKING

(75) Inventor: Zhou Yang, Oak Ridge, NC (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 0 days.

(21) Appl. No.: 12/073,020

(22) Filed: Feb. 28, 2008

(51) Int. Cl.
*F02D 13/04* (2006.01)
*F02D 13/06* (2006.01)

(52) U.S. Cl. ..... 123/321; 123/90.23

(58) Field of Classification Search ..... 123/321, 123/320, 322, 90.11, 90.12, 90.16, 90.23, 123/90.25
See application file for complete search history.

(56) References Cited

U.S. PATENT DOCUMENTS 6,125,828 A * 10/2000 Hu ..... 123/568.14
6,148,793 A * 11/2000 Faletti et al. ..... 123/322
6,189,504 B1 * 2/2001 Israel et al. ..... 123/321
6,293,248 B1 * 9/2001 Zsoldos et al. ..... 123/321

* cited by examiner

*Primary Examiner*—Mahmoud Gimie
(74) *Attorney, Agent, or Firm*—David R. Yohannan, Esq.; Kelley Drye & Warren LLP

(57) ABSTRACT

A control method for transitioning from positive power to engine braking (and vice-versa) is disclosed. This transition may be made using variable valve actuation and two-stroke braking. The process may involve three engine operation modes: positive power (i.e., firing or non-braking), engine braking, and transition between engine braking and positive power. The intake and exhaust valve actuations provided for each of the different modes of operation may be different from each other.

12 Claims, 5 Drawing Sheets

METHOD FOR VARIABLE VALVE ACTUATION TO PROVIDE POSITIVE POWER AND ENGINE BRAKING

FIELD OF THE INVENTION

The present invention relates generally to methods for actuating one or more intake, exhaust and/or auxiliary valves in an engine. In particular, the present invention relates to methods for providing variable valve actuation for transitioning between positive power operation and engine braking operation of engine valves.

BACKGROUND OF THE INVENTION

Valve actuation in an internal combustion engine is required in order for the engine to produce positive power, engine braking, exhaust gas recirculation (EGR), and/or brake gas recirculation (BGR). During positive power, one or more intake valves may be opened to admit fuel and air into a cylinder for combustion. One or more exhaust valves may be opened to allow combustion gas to escape from the cylinder. Intake, exhaust, and/or auxiliary valves may also be opened for exhaust gas recirculation events during positive power at various times to recirculate gases from the exhaust manifold into the engine cylinder for improved emissions.

Engine valve actuation also may be used to produce engine braking and brake gas recirculation when the engine is not being used to produce positive power. During engine braking, one or more exhaust valves may be selectively opened to convert, at least temporarily, the engine into an air compressor. In doing so, the engine develops retarding horsepower to help slow the vehicle down. This can provide the operator with increased control over the vehicle and substantially reduce wear on the service brakes of the vehicle. The exhaust and/or auxiliary valves may also be opened during engine braking at times when the engine piston is near bottom dead center to recirculate gases from the exhaust manifold into the engine cylinder to improve engine braking.

Engine valve(s) may be actuated to produce compression-release braking and/or bleeder braking. The operation of a compression-release type engine brake, or retarder, is well known. As a piston travels upward during its compression stroke, the gases that are trapped in the cylinder are compressed. The compressed gases oppose the upward motion of the piston. During engine braking operation, as the piston approaches the top dead center (TDC), at least one exhaust valve is opened to release the compressed gases in the cylinder to the exhaust manifold, preventing the energy stored in the compressed gases from being returned to the engine on the subsequent expansion down-stroke. In doing so, the engine develops retarding power to help slow the vehicle down. An example of a prior art compression release engine brake is provided by the disclosure of Cummins, U.S. Pat. No. 3,220,392 (November 1965), which is incorporated herein by reference.

The basic principles of exhaust gas recirculation (EGR) and brake gas recirculation (BGR) are also well known. After a properly operating engine has performed work on the combination of fuel and inlet air in its combustion chamber, the engine exhausts the remaining gas from the engine cylinder. An EGR or BGR system allows a portion of these exhaust gases to flow back into the engine cylinder. This recirculation of gases into the engine cylinder may be used during positive power operation, and/or during engine braking cycles to provide significant benefits.

During positive power operation, an EGR system may be primarily used to improve engine emissions. During engine positive power, one or more intake valves may be opened to admit fuel and air from the atmosphere, which contains the oxygen required to burn the fuel in the cylinder. The air, however, also contains a large quantity of nitrogen. The high temperature found within the engine cylinder causes the nitrogen to react with any unused oxygen and form nitrogen oxides (NOx). Nitrogen oxides are one of the main pollutants emitted by diesel engines. The recirculated gases provided by an EGR system have already been used by the engine and contain only a small amount of oxygen. By mixing these gases with fresh air, the amount of oxygen entering the engine may be reduced and fewer nitrogen oxides may be formed. In addition, the recirculated gases may have the effect of lowering the combustion temperature in the engine cylinder below the point at which nitrogen combines with oxygen to form NOx. As a result, EGR systems may work to reduce the amount of NOx produced and to improve engine emissions. Current environmental standards for diesel engines, as well as proposed regulations, in the United States and other countries indicate that the need for improved emissions will only become more important in the future.

A BGR system may be used to optimize retarding power during engine braking operation. As discussed above, during engine braking, one or more exhaust valves may be selectively opened to convert, at least temporarily, the engine into an air compressor. By controlling the pressure and temperature in the engine using BGR, the level of braking may be optimized at various operating conditions.

In many internal combustion engines, the engine intake and exhaust valves may be opened and closed by fixed profile cams, and more specifically by one or more fixed lobes which may be an integral part of each of the cams. Benefits such as increased performance, improved fuel economy, lower emissions, and better vehicle drivability may be obtained if the intake and exhaust valve timing and lift can be varied. The use of fixed profile cams, however, can make it difficult to adjust the timings and/or amounts of engine valve lift to optimize them for various engine operating conditions.

One method of adjusting valve timing and lift, given a fixed cam profile, has been to provide valve actuation that incorporates a "lost motion" system in the valve train linkage between the valve and the cam. Lost motion is the term applied to a class of technical solutions for modifying the valve motion proscribed by a cam profile with a variable length mechanical, hydraulic, and/or other linkage assembly. In a lost motion system, a cam lobe may provide the "maximum" (longest dwell and greatest lift) motion needed over a full range of engine operating conditions. A variable length system may then be included in the valve train linkage, intermediate of the valve to be opened and the cam providing the maximum motion, to subtract or lose part or all of the motion imparted by the cam to the valve.

Some previous lost motion systems have utilized high speed mechanisms to rapidly vary the length of the lost motion system. By using a high speed mechanism to vary the length of the lost motion system, precise control may be attained over valve actuation, and accordingly optimal valve actuation may be attained for a wide range of engine operating conditions. Systems utilizing high speed control mechanisms, however, can be costly to manufacture and operate.

One proposed method of adjusting valve timing and lift at high speed, given a fixed cam profile, has been to provide variable valve actuation (VVA) by incorporating a "lost motion" device in the valve train linkage between the valve and the cam which provides more than full on-off lost motion actuation. A VVA lost motion system may be included in the valve train linkage, intermediate of the valve to be opened and the cam providing the maximum motion, to selectively subtract or lose part or all of the motion imparted by the cam to the valve on an engine cycle-by-cycle basis so as to provide multiple levels of valve actuation. When a VVA system loses all of the motion imparted from a cam to an engine valve, the resulting non-actuation of the engine valve for the cylinder is referred to as "cylinder cut-out." An example of a VVA system capable of the foregoing is disclosed in U.S. Pat. No. 6,883,492, which is incorporated herein by reference.

Still other lost motion systems have utilized a dedicated cam to provide engine braking valve actuation. In such systems, separate cam lobes may be used to provide the valve actuation motion required for engine braking to one or more exhaust valves. In such systems, the engine braking valve actuation motion may be added to the main exhaust valve actuation motion without interfering with the timing or magnitude of the latter. An example of such a dedicated engine braking cam lost motion system is disclosed in U.S. patent application Ser. No. 11/123,063, filed May 6, 2005 which is incorporated herein by reference.

While there has been substantial development of methods of operating engine valves for both positive power operation and engine braking operation, there has been little development of methods of operating engine valves during the time that the engine is transitioning between positive power operation and engine braking. During this transition time, one or more of the engine valves and the valve trains associated with them may be subjected to undesirable loads if the engine valve actuation is immediately switched between positive power operation and engine braking operation. The undesirable loads, if repeated or sufficiently severe can cause engine damage and/or failure. Accordingly, there is a need for a method of operating engine valves when the engine is transitioning between positive power operation and engine braking that may reduce loads placed on the engine valves and/or valve train.

Further, while there has been significant development of variable valve actuation methods for intake, exhaust, and/or auxiliary valves in recent years, there remains a need for cost efficient and effective methods of variable valve actuation during positive power operation and/or engine braking operation. In particular, there is a need for improved methods for providing variable valve actuation which can provide improved engine performance by utilizing a variety of variable valve actuation functions for intake, exhaust, and auxiliary valves, including, but not limited to, combinations of late intake valve opening, early intake valve closing, late intake valve closing, late exhaust valve opening, early exhaust valve closing, exhaust gas recirculation, two or four cycle brake gas recirculation, and main intake and/or main exhaust event deactivation.

SUMMARY OF THE INVENTION

Responsive to the foregoing challenges, Applicant has developed a method of variable valve actuation of one or more valves, such as an intake valve, an exhaust valve and a brake valve. The method includes variable valve actuation during a positive power mode, an engine braking mode and transitions between these modes. When transitioning from positive power mode to engine braking mode, a late intake valve opening (LIVO) is actuated, an early intake valve closing (EIVC) is actuated, an early exhaust valve closing (EEVC) is actuated and the brake valve is enabled. When transitioning from engine braking mode to positive power mode, the late intake valve opening (LIVO) is actuated, the early intake valve closing (EIVC) is actuated, the early exhaust valve closing (EEVC) is actuated and the brake valve is disabled. The late intake valve opening (LIVO) is selectively actuated for a main intake event. The late intake valve opening (LIVO) may occur somewhere near intake top dead center (TDC). The early intake valve closing (EIVC) is selectively actuated for the main intake event. The early intake valve closing (EIVC) may occur somewhere between intake bottom dead center (BDC) and compression top dead center (TDC). The early exhaust valve closing (EEVC) is selectively actuated for a main exhaust event. The early exhaust valve closing (EEVC) may occur somewhere near intake top dead center (TDC).

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

In order to assist the understanding of this invention, reference will now be made to the appended drawings, in which like reference numerals refer to like elements. The drawings are exemplary only, and should not be construed as limiting the invention.

DETAILED DESCRIPTION OF PREFERRED EMBODIMENTS OF THE INVENTION

Reference will now be made in detail to embodiments of the system and method of the present invention, examples of which are illustrated in the accompanying drawings. As embodied herein, the present invention includes systems and methods for providing the actuation of one or more engine valves.

Figure 1:
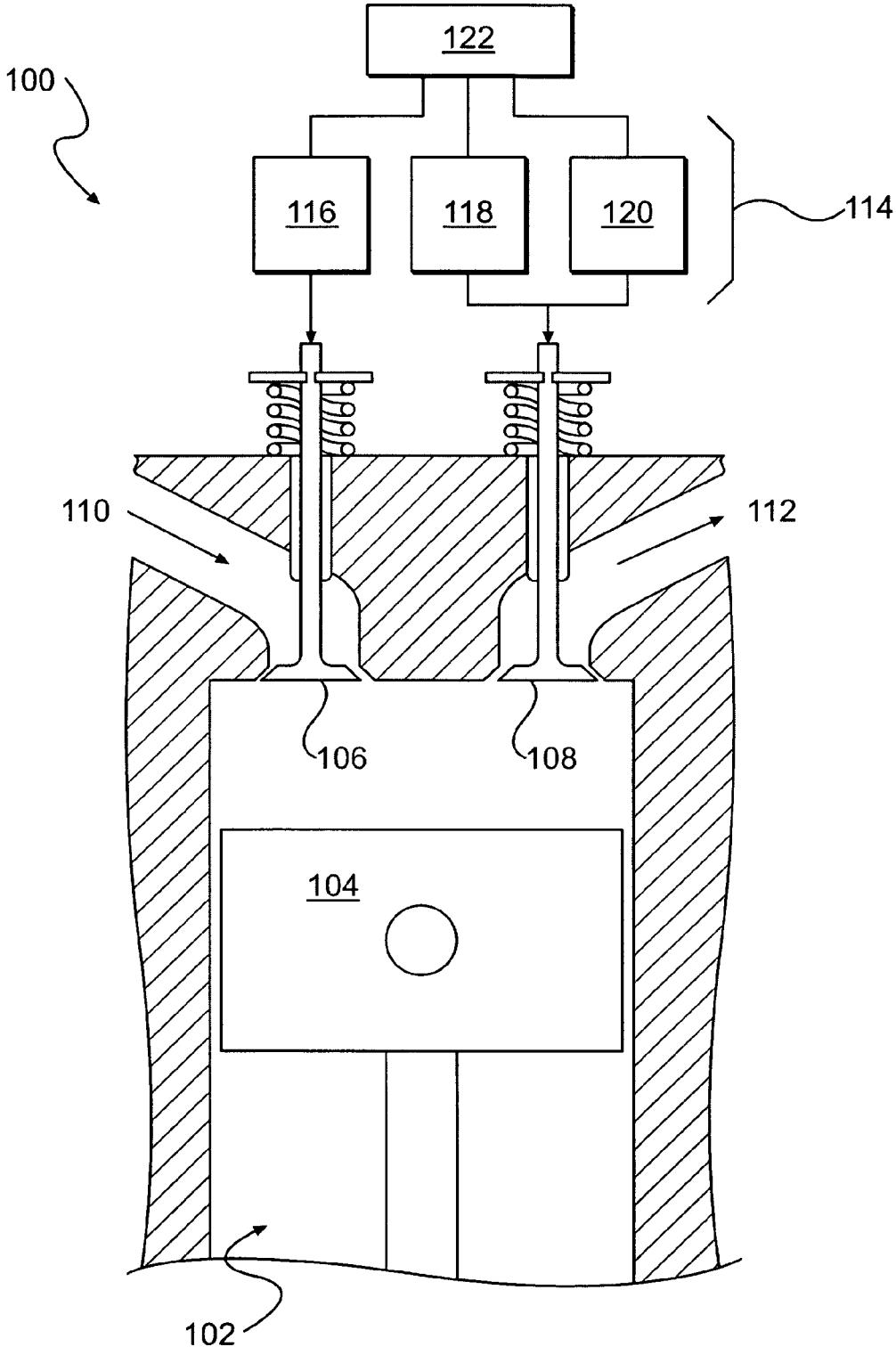
FIG. 1 is an example embodiment of a system for implementing the method of transitioning between positive power and engine braking of FIG. 8.

FIG. 1 is an embodiment of a valve actuation system 100 capable of implementing embodiments of methods of positive power engine operation, engine braking operation, and transitioning between positive power and engine braking operation. The valve actuation system 100 may have a cylinder 102 in which a piston 104 may reciprocate upward and downward repeatedly during the time the engine is in operation. At the top of the cylinder 102, there may be at least one intake valve 106 and at least one exhaust valve 108. The intake valve 106 and the exhaust valve 108 may be opened and closed to provide communication with an intake gas passage 110 and an exhaust gas passage 112, respectively. The intake 106 and exhaust valves 108 may be opened and closed by valve actuating subsystems 114, such as, for example, an intake valve actuating subsystem 116, an positive power exhaust valve actuating subsystem 118, and an engine braking exhaust valve actuating subsystem 120. The valve actuating subsystems 114 may be mechanical, hydraulic, hydro-mechanical, electromagnetic, or another kind of system, and may optionally include a common rail or lost motion system. The valve actuating subsystems 114 may actuate the intake valve 106 and exhaust valve 108 to produce engine valve events, such as but not limited to the following events: main intake, main exhaust, compression release braking, bleeder braking, brake gas recirculation and exhaust gas recirculation. Further, the valve actuating subsystems may be controlled to provide selective combinations of the following variable valve actuation events, including, but not necessarily limited to, late main intake valve event opening, early main intake valve event closing, late main intake valve event closing, late main exhaust valve event opening, early main exhaust valve event closing, exhaust gas recirculation, one or two brake gas recirculation events, two or four stroke compression-release engine braking, bleeder engine braking, partial bleeder engine braking, main intake event deactivation, and/or main exhaust event deactivation.

The valve actuating subsystems 114 may be controlled by a controller 122 to selectively control, for example, the amount and timing of the actuations. The controller 122 may comprise any electronic, mechanical, hydraulic, electro-hydraulic, or other type of control device for communicating with the valve actuating subsystems 114 and causing some or all of the possible intake and exhaust valve actuations to be transferred to the intake valve 106 and the exhaust valve 108. The controller 122 may include a microprocessor and instrumentation linked to other engine components to determine and select the appropriate operation of the engine valves. Information may be collected from the engine components and may include, without limitation, engine speed, vehicle speed, oil temperature, manifold (or port) temperature, manifold (or port) pressure, cylinder temperature, cylinder pressure, particulate information, other exhaust gas parameters, and crank angle. This information may be used by the controller 122 to control the valve actuating subsystems 114 over various operating conditions for various operations, such as positive power, engine braking, engine gas recirculation (EGR) and brake gas recirculation (BGR).

An example embodiment of a valve actuation system, such as valve actuation system 100 of FIG. 1, may provide variable valve opening and/or closing of one or more engine valves, as illustrated in FIGS. 2-7. By varying the valve timing (i.e., the times at which the engine valves are opened and/or closed), engine performance during positive power, engine braking, and/or engine gas recirculation/brake gas recirculation (EGR/BGR) operation may be improved. FIGS. 2-7 illustrate engine valve lifts and cam profiles over a full four engine cycles of 720 degrees, which include two top dead center (TDC) engine piston positions and two bottom dead center (BDC) engine piston positions spaced along the horizontal axis. The four phases or strokes of diesel operation of a typical internal combustion engine, namely, expansion, exhaust, intake, and compression are labeled in FIG. 2 and are intended to define these four phases or strokes as vertical columns for all of FIGS. 2-7. Each of the four individual cycles is generally denoted by 180 degrees of crank shaft rotation. In FIGS. 2-7, solid lines represent normal operation (or cam profiles) and dashed lines represent optional or selective operations, such as, but not limited to, those operations used during transition periods between positive power operation and engine braking operation. It is appreciated, however, that some actuations illustrated with solid lines could be selectively discontinued, such as for example, deactivation of main intake and/or main exhaust valve events.

Figure 2:
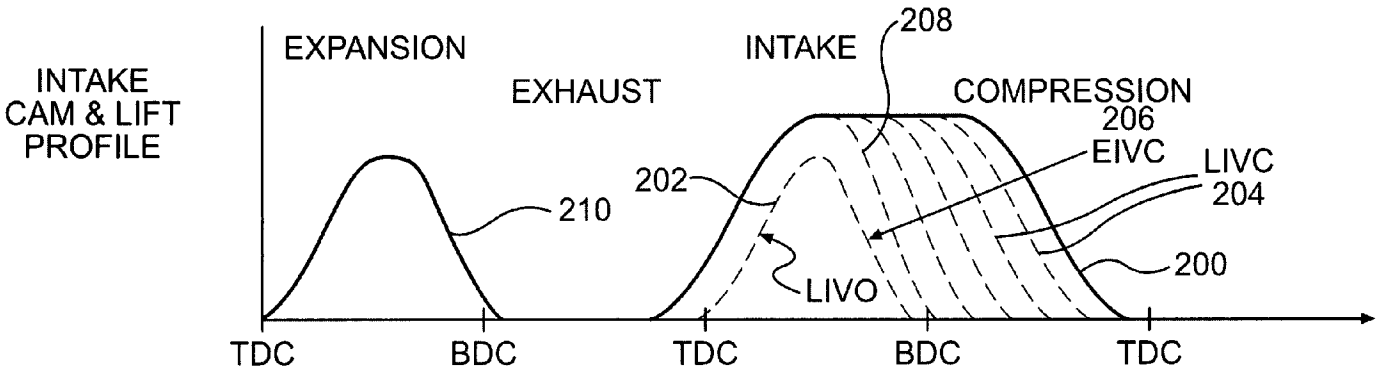
FIG. 2 illustrates example intake cam and valve lift profiles for use in accordance with a first embodiment of the present invention.

FIG. 2 is a diagram of an example intake cam and lift profile that may be provided in accordance with the first embodiment of the present invention. FIG. 2 generally shows a main intake valve event and cam profile 200 which may be carried out during the intake phase and a second optional main intake valve event 210 which may be carried out during the expansion phase for two stroke engine braking. During the intake phase, the intake valve actuation subsystem may vary intake valve actuation timing so that the intake valve is closed earlier or later than a conventional intake valve, and/or opened later than default operation (solid lines). The timing may be varied to produce optional late intake valve opening (LIVO) (dashed line) 202, and/or optional early intake valve closing (EIVC) (dashed line) 206 or late intake valve closing (LIVC) 204. Late intake valve opening (LIVO) 202 may be delayed a variable amount of time around the top dead center (TDC) position during the intake phase. Late intake valve closing (LIVC) 204 may be delayed a variable amount of time measured from the conventional intake valve closing profile 208 between about the bottom dead center (BDC) position in the intake phase and the top dead center (TDC) position in the compression phase. Selective late intake valve opening (LIVO) may be desirable for a second engine braking event (410 as shown in FIG. 4) and selective late intake valve closing (LIVC) may be desirable to reduce emissions during positive power operation.

Figure 3:
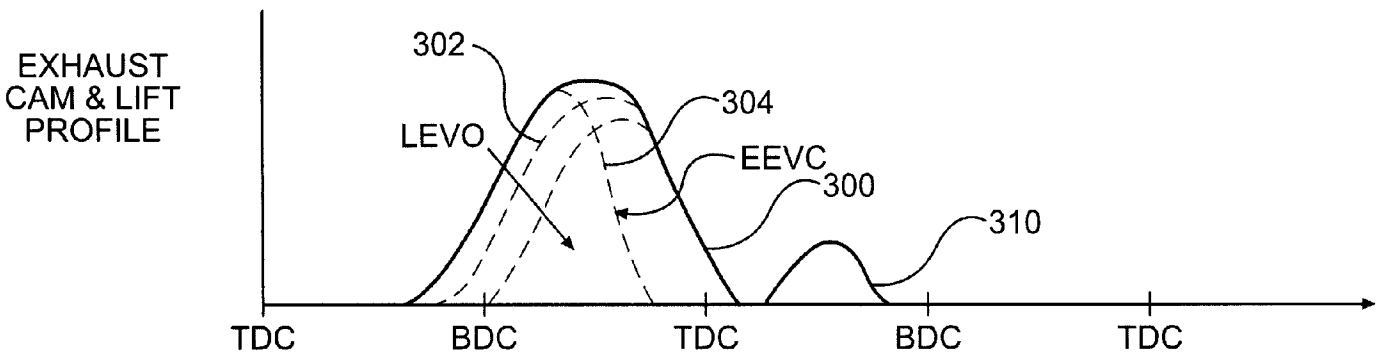
FIG. 3 illustrates example exhaust cam and lift profiles for use in accordance with the first embodiment of the present invention.

FIG. 3 is a diagram of an example exhaust cam and lift profile that may be provided in accordance with the first embodiment of the present invention. FIG. 3 generally shows a main exhaust valve event and cam profile 300 which may be carried out during the exhaust phase and an optional engine gas recirculation (EGR) valve event 310 that may be carried out during the intake phase. During the exhaust phase, the positive power exhaust valve actuating subsystem may vary exhaust valve actuation timing so that the exhaust valve is closed earlier and/or opened later than default operation (solid lines). FIG. 3 illustrates optional late exhaust valve opening (LEVO) (dashed lines) 302 and optional early exhaust valve closing (EEVC) (dashed line) 304. The late exhaust valve opening (LEVO) may be delayed (or clipped) a variable amount of time to begin as late as near bottom dead center (BDC) of the exhaust phase. During the intake phase, the exhaust valve may optionally be opened for an engine gas recirculation event (EGR) (solid line) 310.

Figure 4:
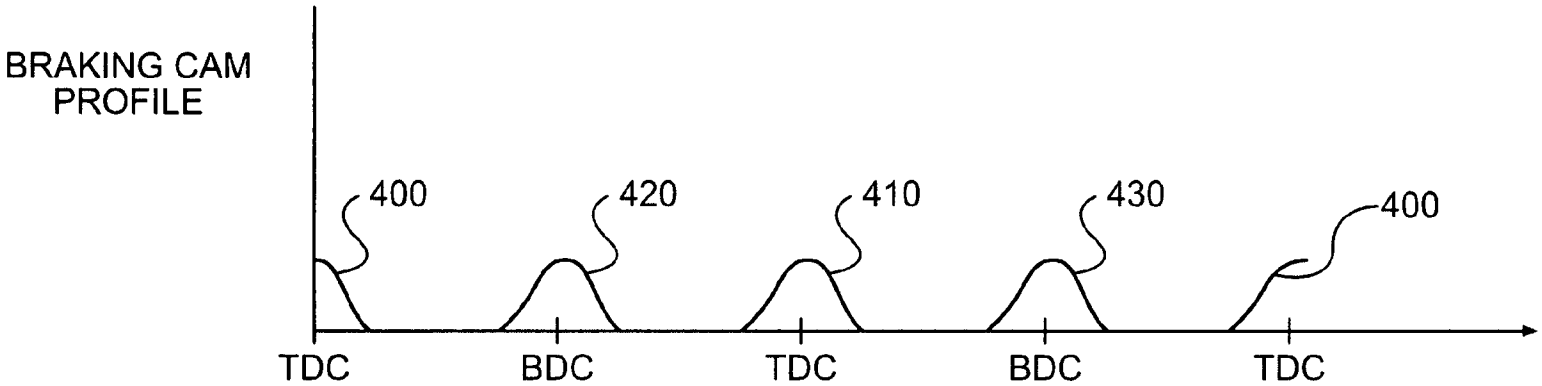
FIG. 4 illustrates an example braking cam and lift profiles for use in accordance with the first embodiment of the present invention.

FIG. 4 is a diagram of an example braking cam and lift profile which may be provided in accordance with the first embodiment of the present invention. FIG. 4 generally shows optional compression release event 400 and optional second compression release event 410, and two optional brake gas recirculation (BGR) events 420 and 430 for each 720 degree engine cycle. Each compression release and brake gas recirculation event may be selectively provided during engine braking and/or transition between positive power and engine braking operation. A first optional compression release braking valve lift event (BVL) 400 may be carried out around top dead center (TDC) between the compression and expansion phases. An optional second compression release braking valve lift event (BVL) 410 may be carried out around top dead center (TDC) between the exhaust and intake phases. An optional second brake gas recirculation event (BGR) 420 may be carried out around bottom dead center (BDC) between the expansion and exhaust phases. An optional first brake gas recirculation event (BGR) 430 may be carried out around bottom dead center (BDC) between the intake and compression phases.

Figure 5:
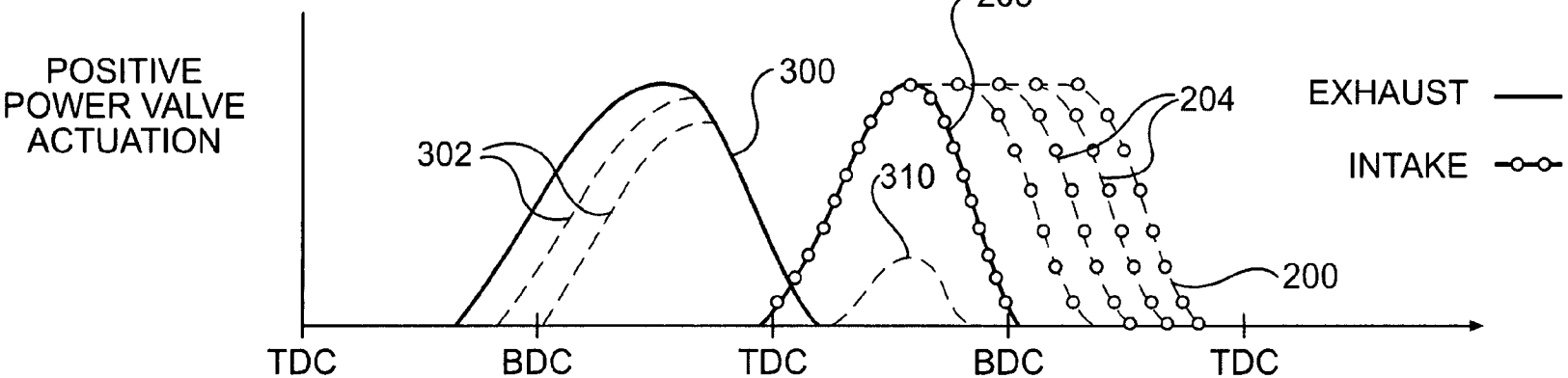
FIG. 5 illustrates example intake and exhaust valve lift profiles that may be provided in accordance with the first embodiment of the present invention during positive power operation of the engine.

FIG. 5 is a diagram of example intake and exhaust valve actuations that may be provided during positive power operation of the engine using a combination of the valve actuations illustrated in FIGS. 2 and 3 in accordance with the first embodiment of the present invention. FIG. 5 generally illustrates a main intake valve opening event 200 with optional late intake valve closing profiles 204 and conventional intake valve closing profile 208, and a main exhaust valve opening event 300 with different exhaust valve opening profiles 302, and an optional exhaust gas recirculation event 310, which may be selectively provided during positive power operation of the engine based on various engine operation parameters referenced above. Specifically, progressively earlier exhaust valve opening may be selected to increase the exhaust gas temperature, which may benefit the after treatment system for NOx reduction.

With continued reference to FIG. 5, during the intake phase of positive power operation, the intake valve may be opened for a main intake event 200 in accordance with the conventional main intake valve actuation profile defined by the solid line with circles 208 or alternatively, in accordance with one of the late intake valve closing profiles (LIVC) (dashed lines with circles) 204. Progressively later intake valve closing as compared with the conventional main intake valve closing profile 208 may be selected to enhance NOx reduction. The late intake valve closing (LIVC) events 204 may be carried out between the bottom dead center (BDC) position between the intake and compression phases and the top dead center (TDC) position between the compression and expansion phases. The optional engine gas recirculation (EGR) event (dashed line) 310 may be provided to decrease NOx by diluting the oxygen rich gas that enters the cylinder from the intake manifold with less oxygenated exhaust gas. The resulting reduced oxygen content of the cylinder at the time of combustion may reduce combustion temperature and thereby reduce the production of NOx. Further, the reduced oxygen content may also result in decreasing the amount of oxygen that is available to form NOx.

Figure 6:
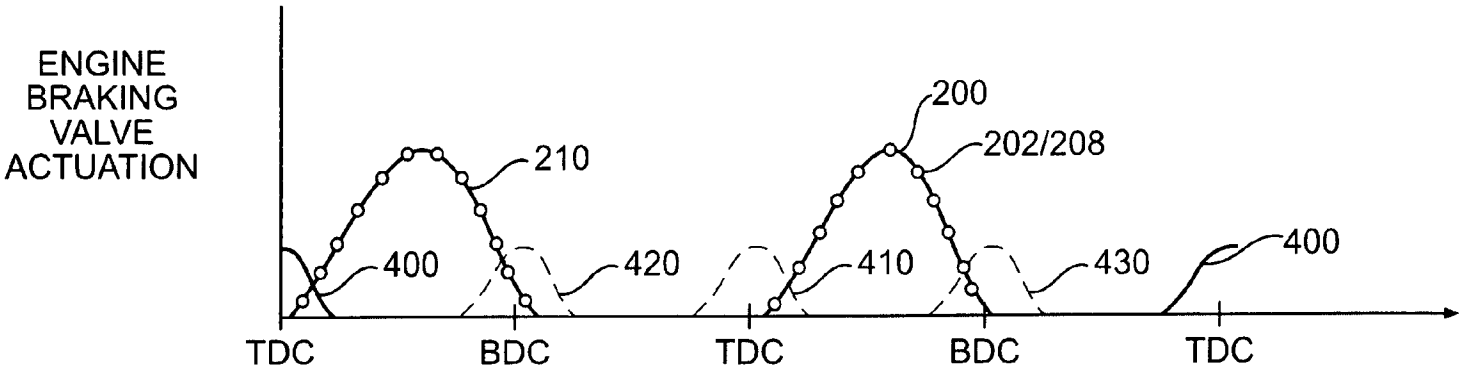
FIG. 6 illustrates example intake and exhaust valve lift profiles that may be provided in accordance with the first embodiment of the present invention during engine braking operation of the engine.

FIG. 6 is a diagram of example intake and exhaust valve actuations which may be provided during engine braking operation of the engine using a combination of the valve actuations illustrated in FIGS. 2-4 in accordance with the first embodiment of the present invention. FIG. 6 generally illustrates two stroke compression release engine braking, meaning that two compression release events are carried out for each 720 degree rotation of the crank shaft. For two stroke compression release engine braking, a main intake valve event 200, an optional second intake valve event 210 (solid lines with circles), a compression release event 400, an optional second compression release event 410, and optional brake gas recirculation events 420 and 430 may be provided. Conventional four stroke compression release engine braking may be provided by selectively providing only the main intake valve event 200, and the compression release event 400 and BGR event 430. The optional second compression release event 410, the optional second intake event 210, and the optional brake gas recirculation event 420 may be selectively provided to increase engine braking power. The main intake valve event 200 may preferably have a LIVO and an EIVC profile varying from 202 to 208 for optimizing the two stroke compression release engine braking.

Two stroke compression release engine braking may provide benefits, such as increased braking power as compared with conventional four stroke compression release engine braking. Furthermore, two cycle compression release engine braking can provide superior retarding power without a large braking load increase on the valve train. Switching directly from positive power operation to two stroke compression release engine braking and/or back, can create undesirable pressures and loads in the engine, however.

Figure 7:
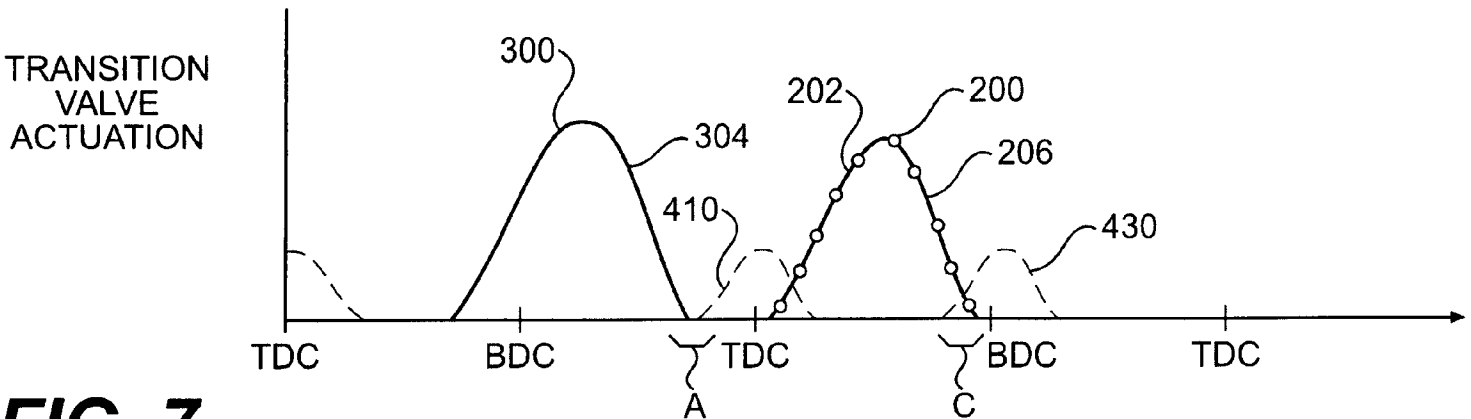
FIG. 7 illustrates example intake and exhaust valve lift profiles that may be provided in accordance with the first embodiment of the present invention during transition between positive power operation and engine braking operation, and vice versa.

FIG. 7 is a diagram of an example of the intake and exhaust valve actuations that may be used to safely transition the operation of the engine between positive power and engine braking modes of operation without producing undesirable pressures and loads in the engine and on the elements which actuate the engine valves (i.e., the valve train). The transition valve actuations may be used to transition from positive power to engine braking, or from engine braking to positive power operation.

Two stroke compression release engine braking presupposes deactivation of the conventional main exhaust valve event 300 during engine braking. After the main exhaust valve event is discontinued, however, there may be some time interval before the optional second compression release valve event 410 is provided on a cyclical basis. If the main intake valve event 200 which follows the second compression release valve event 410 is carried out before the second compression release valve event 410 begins to be provided, but after the main exhaust valve event 300 is discontinued, then pressure in the cylinder against which the intake valve is opened for the main intake valve event 200 will be much higher than it is during positive power operation or four stroke engine braking operation. The pressure applied to the intake valve can be so high in such circumstances as to damage the valve train. Providing late intake valve opening (LIVO) 202 during this time interval may prevent opening of the intake valve against excessively high pressures during the transition to engine braking. In order to avoid such situations, the transition valve actuations illustrated in FIG. 7 may be provided in accordance with the method described in connection with FIG. 8, described below.

During the transition valve actuation period, the main exhaust valve event 300 may be provided with an early exhaust valve closing (EEVC) profile 304. Further, the optional second compression release valve event 410 may be provided around top dead center (TDC) of the exhaust phase. Preferably, the early exhaust valve closing (EEVC) 304 may be carried out so that the exhaust valve closes before the optional second compression release valve event 410 begins. During the intake phase, the main intake valve event 200 may be carried out with a late intake valve opening (LIVO) profile 202 and an early intake valve closing (EIVC) profile 206 (dashed line with circles).

The late intake valve opening (LIVO) 202 may reduce excessive loads on the intake valve train during the transition to and/or from engine braking. In the same way that late intake valve opening (LIVO) 202 may reduce the load on the intake valve train during the transition to engine braking, early intake valve closing (EIVC) 206 accompanying the LIVO 202 may enhance BGR by the first BGR lift 430. After the transition to engine braking, the main intake valve event 200 may assume a more conventional main valve closing profile 208. The first brake gas recirculation (BGR) event 430 also may be provided around bottom dead center (BDC) of the intake phase during the transition period.

With continued reference to FIG. 7, in one embodiment of the present invention, the valve actuation system may act on multiple exhaust valves via a valve bridge during positive power operation. In such cases, engine braking may be provided by actuating only one of the exhaust valves per cylinder without applying force to the valve bridge. When such a system is used to provide two cycle compression release engine braking, the second compression release event 410 could begin before the main exhaust valve event 300 ends. In such situations, early exhaust valve closing (EEVC) 304 can be used to prevent the valve bridge from becoming unbalanced due to the valve bridge moving toward an exhaust valve closed position while, at the same time, the engine brake begins to actuate one of the exhaust valves for the second compression release valve event 410. This unbalanced condition may be avoided by ensuring the that the early exhaust valve closing event 304 concludes before the second compression release valve event 410 begins, as shown in FIG. 7.

Figure 8:
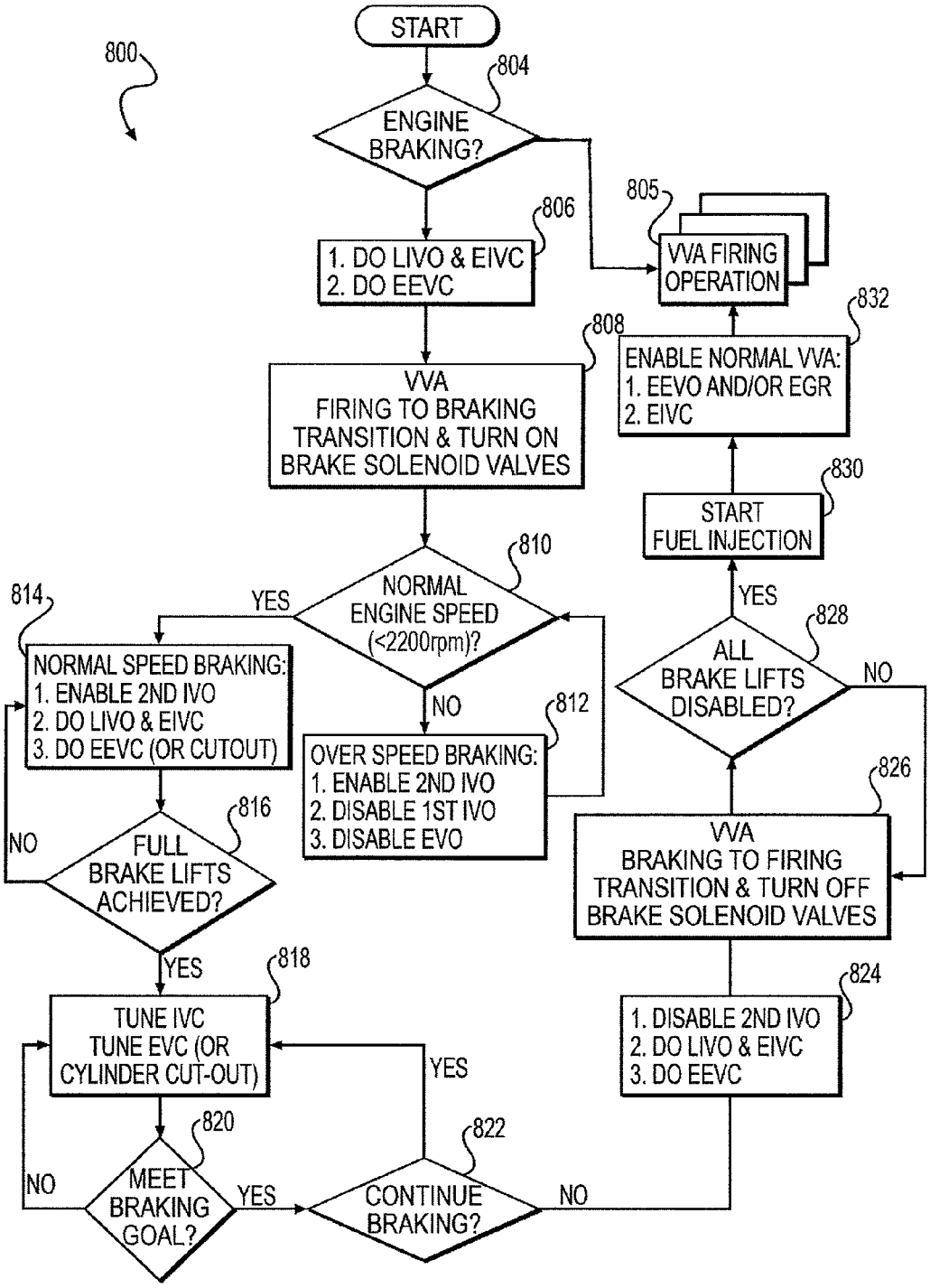
FIG. 8 is a flow diagram of the steps of engine valve operation that may be used to achieve the intake and exhaust valve lift profiles of FIGS. 5-7 in accordance with the first embodiment of the present invention.

A method 800 of transitioning between positive power and engine braking operation is illustrated by the flow chart of FIG. 8. The method starts at step 802 at which point the engine is presumed to be in a positive power mode of operation. In step 804 the controller may determine if engine braking is to be carried out. An indication of a desire to switch to an engine braking mode of operation may be provided in any number of ways, including but not limited to a vehicle operator depressing a brake pedal. If engine braking is not desired, variable valve actuation for positive power operation may be continued in accordance with step 805. If engine braking is desired, the controller may cause the supply of fuel to the engine cylinders in which engine braking is desired to be discontinued, and enable the engine brake to begin operating in step 806, and the variable valve actuation system may be instructed to vary operation of the intake valve(s) such that late intake valve opening (LIVO) and an early intake valve closing (EIVC) are provided, and to vary operation of the exhaust valve(s) to provide early exhaust valve closing (EEVC) in step 806. For a hydraulically actuated engine brake, step 808 may involve activation of solenoids to provide the engine brake with hydraulic fluid. Steps 806 and 808 may provide the transition from positive power operation to engine braking operation without interference between the WA valve events (shown in FIG. 5) and the engine braking valve events generated from the braking cam profiles shown in FIG. 4.

In step 810, the controller may determine whether the engine speed is below a normal engine speed threshold, for example, not faster than a predetermined limit of 2200 rpm. If the engine speed is at or above this threshold, then over speed braking may be performed in step 812. The over speed braking valve actuation may include providing both compression release engine braking events (events 400 and 410 in FIG. 4) and both brake gas recirculation events (events 420 and 430 in FIG. 4) as well as enablement of the optional second intake valve event (event 210 in FIG. 2), disablement of the main intake valve event (event 200 in FIG. 2), and disablement of the main exhaust valve event (event 300 in FIG. 3). Disabling the main intake and exhaust valve events may eliminate the valve train no-follow issues that can occur at over speed conditions. Even without the main valve events there may still be enough engine braking power due to the second intake valve opening 210 with all the braking valve events during the over speed condition to slow the engine. The over speed braking valve actuation may be continued until engine speed falls below the normal engine speed threshold.

Once the engine speed falls below the normal engine speed threshold, then normal speed engine braking may be performed in accordance with step 814. In step 814, the variable valve actuation system may provide both compression release engine braking events (events 400 and 410 in FIG. 4) and both brake gas recirculation events (events 420 and 430 in FIG. 4) as well as the first main intake valve event and the optional second intake valve event (events 200 and 210 in FIG. 2). Both the two compression-release events and the two BGR events may be provided at this point. Engine braking power can be varied, tuned or optimized through variable valve actuation of the main valve events. The main intake valve event 200 may be carried out with a late intake valve opening profile 202 and an early intake valve closing profile 206. Further, the main exhaust valve event 300 may be carried out with an early exhaust valve closing profile 304 or optionally the main exhaust valve event may be completely cutout. Main exhaust valve cutout is considered to be the most extreme form of early exhaust valve closing (EEVC), and within the scope of the present invention. Normal speed braking may be carried out until the compression release engine braking events 400 and 410 are determined in step 816 to be fully provided because an engine brake solenoid valve may take a much longer time to provide engine oil for a full lift of the engine braking valve(s) than the trigger valve used for VVA valve events.

Once full lift of the compression release engine braking events 400 and 410 are confirmed in step 816, in step 818 the controller may cause the variable valve actuation system to "tune" or vary the main intake valve event closing time and/or the main exhaust valve event closing time in an attempt to achieve a desired level of engine braking. Optionally, the controller may cause cylinder cut-out for one or more selected exhaust valves to increase the level of engine braking in connection with the attempt to achieve the desired level of engine braking. The controller may determine in step 820 whether or not the desired level of engine braking has been achieved. If the desired level of engine braking has not been achieved, the variable valve actuation system may attempt to further vary the main intake valve event closing time and/or the main exhaust valve event closing time in step 818 until the desired level of braking is obtained or engine braking is no longer desired.

Once the desired level of engine braking is confirmed in step 820, or a steady state of the best available level of engine braking is achieved, the controller may determine in step 822 if engine braking should be continued. As long as engine braking continues to be desired, the engine braking system may cycle between steps 818, 820 and 822. As soon as engine braking is no longer desired, as typically indicated by the controller, the system may begin to transition back to positive power operation in step 824.

The transition from engine braking to positive power operation may be started in step 824 by disabling the optional second intake valve event (event 210 in FIG. 2). At this time, the main intake valve event 200 may be carried out with a late intake valve opening profile 202 and an early intake valve closing profile 206. Further, the main exhaust valve event 300 may be carried out with an early exhaust valve closing profile 304.

Next, in step 826, the controller may disable the engine brake. For example, for a hydraulically actuated engine brake, step 826 may involve deactivation of solenoids so that the supply of hydraulic fluid to the engine brake is discontinued. Engine braking may continue to be carried out until the compression release engine braking events 400, 410, 420 and 430 (i.e., the valve lifts associated with these events) are determined in step 828 to be completely discontinued because an engine brake solenoid valve may take a much longer time to drain engine oil for full closure of the engine braking valve(s) than the trigger valve used to control variable valve actuation events. After engine braking is determined to have ended in step 828, in step 830 the controller may cause a supply of fuel to be provided to the engine cylinders in which engine braking has ended. Thereafter, with reference to FIGS. 5 and 8, in step 832 the variable valve actuation system may provide positive power operation of the engine, which may include a main exhaust valve event 300 with an early exhaust valve opening profile 302, an exhaust gas recirculation event 310, and a main intake valve event 200 with an early intake valve closing profile 206 (FIG. 2). Positive power variable valve actuation may then be selectively varied as need in step 805.

The foregoing transitional valve actuation timing may be used between the time the engine brake first begins to operate and the time that full engine braking valve lift is achieved, as well as between the time the engine brake first begins to de-activate and the time that engine braking valve lift is completely eliminated. It is further appreciated that the transitional valve actuation timing can be used on any number of cylinders independent of the valve actuation timing used for other cylinders in a single engine.

The foregoing benefits are not necessarily limited to engines that have only traditional "exhaust" and "intake" valves. It is also contemplated that the variable valve actuation described above may be applied to an engine that utilizes auxiliary engine valves dedicated to some purpose other than intake or exhaust functions, such as for example engine braking or engine gas recirculation (EGR).

It will be apparent to those skilled in the art that variations and modifications of the present invention can be made without departing from the scope or spirit of the invention. Thus, it is intended that the present invention cover all such modifications and variations of the invention, provided they come within the scope of the appended claims and their equivalents.

What is claimed is:

1. A method of transitioning between positive power operation and engine braking operation in an internal combustion engine cylinder, said method comprising the steps of:

actuating intake and exhaust valves associated with the engine cylinder in a manner that permits the engine cylinder to generate positive power;

determining a desire to transition the engine cylinder from generating positive power to providing engine braking;

actuating the intake and exhaust valves associated with the engine cylinder in a manner that permits the engine cylinder to transition from generating positive power to providing engine braking in response to the determination of the desire to transition from generating positive power to providing engine braking;

determining that the engine cylinder is providing engine braking; and actuating the intake and exhaust valves associated with the engine cylinder in a manner that permits the engine cylinder to provide a desired level of engine braking in response to the determination that the engine cylinder is providing engine braking, wherein the manner in which the intake and exhaust valves are actuated for the transition from generating positive power to providing engine braking differs from the manner in which the intake and exhaust valves are actuated for generating positive power and providing engine braking.

2. The method of claim 1, wherein the step of actuating the intake and exhaust valves associated with the engine cylinder in a manner that permits the engine cylinder to transition from generating positive power to providing engine braking comprises the step of:

disabling fuel from being supplied to the engine cylinder;

actuating the intake valve to provide a main intake valve event with late intake valve opening and early intake valve closing;

actuating the exhaust valve to provide a main exhaust valve event with early exhaust valve closing;

determining if an engine speed is below a normal engine speed threshold; and actuating the intake and exhaust valves in a first manner if the engine speed is below the normal engine speed threshold and actuating the intake and exhaust valves in a second manner if the engine speed is at or above the normal engine speed threshold, wherein the first manner and the second manner intake and exhaust valve actuations are different.

3. The method of claim 2, wherein:

the step of actuating the intake and exhaust valves in the first manner comprises:

actuating the intake valve to provide a first main intake valve event with late intake valve opening and early intake valve closing, and to provide a second intake valve event; and actuating the exhaust valve to provide a main exhaust valve event with early exhaust valve closing or cut out of the exhaust valve actuation for a main exhaust valve event; and the step of actuating the intake and exhaust valves in the second manner comprises:

actuating the intake valve to provide a second intake valve event during an expansion stroke and disabling the intake valve from providing a first main intake valve event during an intake stroke; and disabling the exhaust valve from providing a main exhaust valve event.

4. The method of claim 1 further comprising a method of transitioning between engine braking operation and positive power operation in an internal combustion engine cylinder, said method comprising the steps of:

actuating the intake and exhaust valves associated with the engine cylinder in a manner that permits the engine cylinder to provide engine braking;

determining a desire to transition the engine cylinder from providing engine braking to generating positive power;

actuating the intake and exhaust valves associated with the engine cylinder in a manner that permits the engine cylinder to transition from providing engine braking to generating positive power in response to the determination of the desire to transition from providing engine braking to generating positive power;

determining that the engine cylinder has ceased to provide engine braking; and actuating the intake and exhaust valves associated with the engine cylinder in a manner that permits the engine cylinder to generate positive power in response to the determination that the engine cylinder has ceased to provide engine braking, wherein the manner in which the intake and exhaust valves are actuated for the transition from providing engine braking to generating positive power differs from the manner in which the intake and exhaust valves are actuated for generating positive power and providing engine braking.

5. The method of claim 4, wherein the step of actuating the intake and exhaust valves associated with the engine cylinder in a manner that permits the engine cylinder to transition from providing engine braking to generating positive power comprises the steps of:

actuating the intake valve to provide a main intake valve event with late intake valve opening and early intake valve closing;

disabling the intake valve from providing a second intake valve event during the expansion stroke; and actuating the exhaust valve to provide a main exhaust valve event with early exhaust valve closing.

6. The method of claim 4 further comprising the step of enabling fuel to be supplied to the engine cylinder after determining that the engine cylinder has ceased to provide engine braking.

7. A method of transitioning between engine braking operation and positive power operation in an internal combustion engine cylinder, said method comprising the steps of:

actuating the intake and exhaust valves associated with the engine cylinder in a manner that permits the engine cylinder to provide engine braking;

determining a desire to transition the engine cylinder from providing engine braking to generating positive power;

actuating the intake and exhaust valves associated with the engine cylinder in a manner that permits the engine cylinder to transition from providing engine braking to generating positive power in response to the determination of the desire to transition from providing engine braking to generating positive power;

determining that the engine cylinder has ceased to provide engine braking; and actuating the intake and exhaust valves associated with the engine cylinder in a manner that permits the engine cylinder to generate positive power in response to the determination that the engine cylinder has ceased to provide engine braking, wherein the manner in which the intake and exhaust valves are actuated for the transition from providing engine braking to generating positive power differs from the manner in which the intake and exhaust valves are actuated for generating positive power and providing engine braking.

8. The method of claim 7, wherein the step of actuating the intake and exhaust valves associated with the engine cylinder in a manner that permits the engine cylinder to transition from providing engine braking to generating positive power comprises the steps of:

actuating the intake valve to provide a main intake valve event with late intake valve opening and early intake valve closing;

disabling the intake valve from providing a second intake valve event during an expansion stroke; and actuating the exhaust valve to provide a main exhaust valve event with early exhaust valve closing.

9. The method of claim 8 further comprising the step of enabling fuel to be supplied to the engine cylinder after determining that the engine cylinder has ceased to provide engine braking.

10. A method of transitioning between positive power operation and engine braking operation in an internal combustion engine cylinder, said method comprising the steps of:

actuating an engine valve associated with the engine cylinder in a manner that permits the engine cylinder to generate positive power;

determining a desire to transition the engine cylinder from generating positive power to providing engine braking;

actuating the engine valve associated with the engine cylinder in a manner that permits the engine cylinder to transition from generating positive power to providing engine braking in response to the determination of the desire to transition from generating positive power to providing engine braking;

determining that the engine cylinder is providing engine braking; and actuating the valve associated with the engine cylinder in a manner that permits the engine cylinder to provide a desired level of engine braking in response to the determination that the engine cylinder is providing engine braking, wherein the manner in which the engine valve is actuated for the transition from generating positive power to providing engine braking differs from the manner in which the engine valve is actuated for generating positive power and providing engine braking.

11. The method of claim 10 wherein the engine valve is an exhaust valve.

12. The method of claim 10 wherein the engine valve is an intake valve.

* * * * *

UNITED STATES PATENT AND TRADEMARK OFFICE
Certificate

Patent No. 7,565,896 B1 Patented: July 28, 2009

On petition requesting issuance of a certificate for correction of inventorship pursuant to 35 U.S.C. 256, it has been found that the above identified Patent, through error and without any deceptive intent, improperly sets forth the inventorship.

Accordingly, it is hereby certified that the correct inventorship of this Patent is: Zhou Yang, Oak Ridge, NC (US); and Ray Gosselin, Windsor, CT (US).

Signed and Sealed this Twenty-fourth Day of July 2012.

STEVE CRONIN
*Supervisory Patent Examiner*
Art Unit 3747
Technology Center 3700